US010827287B2

(12) United States Patent
Arnold et al.

(10) Patent No.: US 10,827,287 B2
(45) Date of Patent: Nov. 3, 2020

(54) METHOD OF OPERATING A HEARING DEVICE AND HEARING DEVICE

(71) Applicant: SIVANTOS PTE. LTD., Singapore (SG)

(72) Inventors: Mirko Arnold, Koenigsbronn (DE); Stefan Petrausch, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/415,066

(22) Filed: May 17, 2019

(65) Prior Publication Data

US 2019/0356990 A1 Nov. 21, 2019

(30) Foreign Application Priority Data

May 17, 2018 (DE) ..... 10 2018 207 780

(51) Int. Cl.
*H04R 25/00* (2006.01)

(52) U.S. Cl.
CPC ..... *H04R 25/505* (2013.01); *H04R 25/353* (2013.01); *H04R 25/356* (2013.01); *H04R 25/453* (2013.01); *H04R 2225/43* (2013.01); *H04R 2460/01* (2013.01); *H04R 2460/09* (2013.01)

(58) Field of Classification Search
CPC .. H04R 25/407; H04R 25/453; H04R 25/505; H04R 2225/025; H04R 2225/43; H04R 2460/01; H04R 2460/05; H04R 2460/09; H04R 25/353; H04R 25/356; H04R 2225/41
USPC ..... 381/312, 313, 317, 320, 321, 71.6, 92
See application file for complete search history.

(56) References Cited

U.S. PATENT DOCUMENTS

| | | | | |
|---|---|---|---|---|
| 8,873,781 | B2 | 10/2014 | Hannemann et al. | |
| 2009/0041260 | A1* | 2/2009 | Jorgensen | G10K 11/178 381/71.6 |
| 2014/0050340 | A1* | 2/2014 | Meyer | H04R 25/50 381/321 |
| 2017/0208397 | A1 | 7/2017 | Aubreville et al. | |
| 2018/0184217 | A1 | 6/2018 | Rosenkranz et al. | |
| 2018/0376258 | A1 | 12/2018 | Tiefenau et al. | |

FOREIGN PATENT DOCUMENTS

| | | | |
|---|---|---|---|
| DE | 102011075006 | B3 | 10/2012 |
| DE | 102016200637 | B3 | 4/2017 |
| DE | 102016226112 | A1 | 6/2018 |
| EP | 3419310 | A1 | 12/2018 |

* cited by examiner

*Primary Examiner* — Huyen D Le
(74) *Attorney, Agent, or Firm* — Laurence A. Greenberg; Werner H. Stemer; Ralph E. Locher

(57) ABSTRACT

In a method of operating a hearing device, an input transducer of the hearing device generates an input signal. A preliminary output signal is generated from this input signal through signal processing. An expected direct sound that is expected to be heard at one ear of a user of the hearing device is ascertained based on the input signal. A propagation delay of the preliminary output signal is ascertained with respect to the expected direct sound. A masking signal is generated based on the input signal and/or the preliminary output signal, taking into account the expected direct sound and/or the propagation delay of the preliminary output signal with respect to the expected direct sound. An output signal is generated based on the preliminary output signal and masking signal.

6 Claims, 6 Drawing Sheets

METHOD OF OPERATING A HEARING DEVICE AND HEARING DEVICE

CROSS-REFERENCE TO RELATED APPLICATION

This application claims the priority, under 35 U.S.C. § 119, of German application DE 10 2018 207 780.0, filed May 17, 2018; the prior application is herewith incorporated by reference in its entirety.

BACKGROUND OF THE INVENTION

Field of the Invention

The invention relates to a method of operating a hearing device in which at least one input transducer of the hearing device generates an input signal, a preliminary output signal is generated from the input signal via signal processing, and an output signal is generated based on the preliminary output signal.

In operation, a hearing device typically converts a sound signal from the environment into an electrical signal by an input transducer and then processes that sound signal in a signal processing unit, and in particular amplifies the sound signal in a frequency-dependent manner in accordance with the user's audiological needs. An output transducer then converts the processed signal into an output sound signal, which is fed to the user's hearing system. Even if the hearing device is being used properly, during operation ambient sound signals may be superimposed on the output sound signal of the hearing device when that output sound signal reaches the user's hearing system. This may occur in particular because, in order to avoid occlusion effects that the user typically perceives as annoying, hearing devices are typically constructed in such a way that they do not completely close the user's ear canal. For this purpose, a small hole (or "vent") may be furnished in the hearing device housing.

The input signal that the input transducer generates from the ambient sound signal is subject to a delay in the signal processing unit, particularly in processes for frequency band filtering, which technical signal processing measures have a limited ability to reduce. Consequently, the output sound signal that has been generated in the hearing device from the output signal of the signal processing unit is superimposed on the ambient sound signal with a slight delay. This may lead to "comb filter" effects in the overall sound signal that the user perceives. Due to the time delay in superimposing the output sound signal of the hearing device on the direct sound signal from the environment, constructive interference occurs in individual signal components as a function of the delay and frequency, causing amplification, while in contrast, for frequencies that are a half-integer multiple of the inverse time delay, destructive interference occurs, causing considerable attenuation in the overall sound signal. The user may perceive such comb filter effects as very unpleasant, because they may, for example, significantly alter the overtone spectra of the audible sound signal by cancelling certain frequencies as a result of destructive interference and/or may "imprint" a harmonic structure on broadband noise.

Such comb filter effects occur in particular when the direct sound signal has approximately the same volume as the output sound signal of the hearing device. For frequencies at which one of these two sound signals is significantly louder, the user will scarcely be able to perceive these interferences.

It is possible, here, to try to minimize the frequency ranges in which the two sound signals have approximately the same volume via amplification in signal processing. In particular, in many cases of hearing loss, significant signal amplification for the output signal is often only required above approximately 1 kHz, so that direct sound strongly dominates below this frequency. The spectral width of the comb filter effects may then be reduced by implementing an abrupt increase in signal amplification in the range in which the two sound signals audibly overlap. As a result, however, comb filter effects still occur in the overlap range although it is narrower, and moreover, in the case of loud direct sound, the options are limited due to the dynamic compression usually implemented in signal processing for this case.

SUMMARY OF THE INVENTION

Accordingly, the object of this invention is to provide a method of operating a hearing device by which the unpleasant consequences of comb filter effects for the user may be avoided as straightforwardly as possible without substantially changing or even impairing user-specific signal processing.

The invention solves this problem through a method of operating a hearing device, wherein at least one input transducer of the hearing device generates an input signal; a preliminary output signal is generated from this input signal through signal processing; an expected direct sound that is expected to be heard at one ear of a user of the hearing device is ascertained based on the input signal; a propagation delay is ascertained with respect to the when the expected direct sound will be heard at the user's hearing system; a masking signal is generated based on the input signal and/or the preliminary output signal, taking into account the expected direct sound and/or the propagation delay with respect to the expected direct sound; and an output signal is generated based on the preliminary output signal and masking signal. Configurations that are advantageous and in part inventive in their own right are described in the dependent claims and in the following description.

Preferably, the preliminary output signal is generated from the input signal by means of frequency-band-specific and, in particular, user-specific signal processing. In particular, the generation of the preliminary output signal from the input signal means that signal components of the input signal are incorporated into the preliminary output signal, and thus what is ascertained based on the input signal is not just one parameter for signal processing on another signal. In this case, the signal components of the input signal may be incorporated with an alteration of their dynamics, frequency spectrum, or a directional characteristic. In addition to the information contained in the input signal itself, the expected direct sound expected to be heard at the hearing device user's hearing system may also be ascertained using shape parameters of the hearing device and/or the user's ear canal. The process of ascertaining in this case contains, in particular, estimation. Preferably, at least one output transducer of the hearing device converts the output signal into an output sound signal that is output to the user's hearing system.

In this case, in particular, the signal that the output transducer of the hearing device would output to the user's hearing system, were it not for the method according to the invention, provides the preliminary output signal. The output signal is generated based on the preliminary output signal and masking signal, and in particular by linearly superposing the two signals mentioned above.

The delay of the preliminary output signal with respect to the expected direct sound may in particular be ascertained in advance, either through a computation based on the latencies occurring during signal processing as a result of the filters used, or through a standardized process of measuring the delay in reproducing interspersed test signals.

The masking signal is preferably generated based on the input signal and/or preliminary output signal, in such a way that the signal components in the preliminary output signal that, combined with the expected direct sound, would produce user-audible comb filter effects at the user's hearing system, are compensated as far as may be achieved without the user being able to perceive artifacts due to the masking signal. Because the occurrence of comb filter effects depends not only on the expected direct sound itself but also on the preliminary output signal, knowledge of the preliminary output signal is required, in addition to knowledge of the input signal and of the expected direct sound given the input signal. However, this knowledge is directly available through knowledge of the algorithms used in signal processing, and for this reason, the preliminary output signal need not be branched off again in order to implement the method, instead, the knowledge of signal properties that the method requires may in particular also be derived from the input signal.

The masking signal is then generated in particular such that destructive interferences between the expected direct sound and the preliminary output signal, which lead to a partial signal cancellation within the scope of comb filter effects, are compensated by an opposed constructive interference with the masking signal, while destructive interference with the masking signal compensate for constructive interferences of the expected direct sound with the preliminary output signal.

Preferably, an amplitude spectrum of the expected direct sound is determined based on the input signal, and an amplitude spectrum of the masking signal is predetermined as a function of the amplitude spectrum of the expected direct sound. In this way, it is possible to account for the fact that the masking signal is intended to compensate the expected direct sound, and in particular to avoid comb filter effects. Because comb filter effects are associated with a particular structure of the amplitude spectrum, namely the amplitude contributions of a signal plotted against the frequency, the amplitude spectrum of the masking signal is preferably tuned to the amplitude spectrum of the expected direct sound, with regard to the associated compensation. The amplitude spectrum of the expected direct sound may be determined here based on the input signal, in particular taking into account shape parameters of the hearing device and/or the user's ear canal, and in particular a transfer function of the input signal may be used that has been ascertained by a corresponding measurement with respect to the expected direct sound.

Preferably in this case, the non-zero values of the amplitude spectrum of the masking signal are substantially provided by the amplitude spectrum of the expected direct sound. Consequently, in those frequency ranges in which masking by means of the masking signal happens at all, the amplitude spectrum of the masking signal is given by the expected direct sound, with the optional addition of a frequency-independent linear amplification factor. The areas in which the masking signal is set to zero may be ascertained in advance, particularly as a function of the user's hearing loss, or dynamically as a function of the input signal.

It proves to be advantageous here if an amplitude spectrum of the preliminary output signal is ascertained and the amplitude spectrum of the masking signal is predetermined as a function of the amplitude spectrum of the preliminary output signal. This makes it possible, in particular, to take into account the signal processing in the hearing device when generating the masking signal, because if possible this processing should be left unchanged so as to optimally compensate for the hearing device user's hearing loss; in particular, however, the ratio between the amplitudes of the expected direct sound and an output sound signal that is generated based on the preliminary output signal determines whether comb filter effects occur.

Preferably in this case, the amplitude spectrum of the masking signal is predetermined in such a way that the masking signal has non-zero amplitude contributions substantially only for those frequencies for which an output sound signal that an output transducer of the hearing device generates based on the preliminary output signal has a sound level that is between −6 dB below and 12 dB above the expected direct sound. As a result, the masking signal only provides non-zero contributions in those frequency ranges in which, based on the ratio of the amplitudes of the expected direct sound to the preliminary output signal or an output sound signal generated therefrom, there is an appreciable likelihood of comb filter effects. In other words, if one of the two sound signals—the expected direct sound or an output sound signal generated from the preliminary output signal—is significantly louder, namely by significantly more than 10 dB, the constructive and destructive interference will be so low that the user of the hearing device will only barely perceive it, or will not perceive it at all. In this case, a corresponding masking signal in the frequency domain is not needed.

In particular, if there is a high signal amplification by the hearing device such that a preliminary output signal would lead to a substantially louder output sound signal than the expected direct sound, then the above-described masking of the masking signal in certain frequency ranges may ensure that the masking signal does not disrupt any desired characteristics of the preliminary output signal, such as directionality or a dynamic range, even if this is not necessary at all in a certain frequency range. On the other hand, a masking signal for a ratio of the sound levels of the preliminary output signal and the expected direct sound in the described range ensures that in the event of short-term changes in amplification—for example due to noise suppression or the onset of compression—and an accompanying change in the preliminary output signal, this change may still be compensated for.

In an advantageous configuration, the masking signal is generated in such a way that a signal delay of an amplitude contribution of the masking signal, with respect to a corresponding amplitude contribution of the expected direct sound, is between 190% and 210%, preferably between 195% and 205%, and particularly preferably exactly 200%, of the propagation delay of the preliminary output signal with respect to the expected direct sound. In a pole-zero diagram of the signal that may be formed from the expected direct sound and the preliminary output signal, the zeroes near the unit circle indicate signal cancellation, which represents comb filter effects. In this case, the frequency of the cancellations determines the angular position of the zero point, and the ratio of the amplitudes of the expected direct sound and the output sound signal determines the distance from the unit circle line. The output sound signal is to be generated in this case based on the preliminary output signal. In this case, a masking signal with the above-mentioned properties must be interpreted in such a way that additional zeroes are added to the transfer function of the resulting sound signal, the angular positions of these zeroes being located between the previous zeroes, preferably exactly at half the intermediate angle, and leading to a displacement of the previous zeroes away from the unit circle line. As a result, signal cancellation is significantly reduced.

Expediently, a number of amplitude contributions of the masking signal are formed based on phase-inverted amplitude contributions of the expected direct sound. This should in particular comprise the fact that a specific spectral contribution of the expected direct sound leads to a corresponding spectral contribution in the masking signal with inverted phase. In this way, the expected direct sound may be compensated particularly advantageously.

If, for example, x(t) represents a sound signal from a sound source, and the direct sound path or signal processing in the hearing device is approximated by a scalar multiplication by a factor D or amplification A, the sound signal y(t) resulting from the propagation delay Δt in the hearing device is given by:

$$y(t)=D\cdot x(t)+A\cdot x(t-\Delta t), \quad \text{(i)}$$

or by $$Y(z)=(D+A\cdot z^{-\Delta n})\cdot X(z) \quad \text{(ii)}$$

in the frequency domain, where Δn corresponds to the propagation delay Δt. Adding a masking signal to the preliminary output signal given by the amplification A gives rise to an additive term in the transfer function, which is represented by the term in parentheses on the right side of equation (ii). Advantageously, the masking signal has a doubled propagation delay 2·Δt compared to the direct sound D·x(t), which leads to a term $C\cdot z^{-2\Delta n}$ in the transfer function of equation (ii):

$$Y(z)=(D+A\cdot z^{-\Delta n}-C\cdot z^{-2\Delta n})\cdot X(z)=H(z)\cdot X(z). \quad \text{(iii)}$$

A frequency dependence of D in equation (iii) via a corresponding frequency dependence of the term C, i.e. D=D(z)=>C=C(z), may also be considered here. It may be shown in this case that a corresponding term in the transfer function H(z) according to equation (iii) with the following properties provides an optimal masking signal with regard to suppressing comb filter effects:

$$C=D\cdot e^{2(\angle A-\angle D)}=|D|\cdot e^{2\angle A-\angle D}, \quad \text{(iv)}$$

where ∠A and ∠D denote the complex phase of A and D respectively. Advantageous values for the masking signal, which results in the signal contribution $Y_C(z)=-C\cdot z^{-2\Delta n}\cdot X(z)$ after reproduction by the output transducer, may also be achieved both for small deviations in the magnitude |C| of the transfer function H(z) from the ideal value |D|, which is relevant for the amplitude of the masking signal, and for small deviations in the aforementioned phase of C. In particular, the relative deviations in magnitude |C| may be up to 6 dB relative to the ideal magnitude |D|, and the absolute deviations of the phase ∠C may be up to ±30°, i.e. π/6 from the ideal phase 2∠A−∠D.

In another advantageous configuration, an additional input transducer of the hearing device generates an additional input signal, and signal processing based on the additional input signal generates the preliminary output signal, with the masking signal being generated based on the input signal and/or the additional input signal and/or the directional signal. This allows compensation of comb filter effects even with directional direct sound. In particular, each directional lobe of the directional characteristic of the directional signal is interpreted as a separate signal source, the superposition of which with the expected direct sound may lead to separate comb filter effects; thus, each of these signal sources preferably generates its own masking signal.

This invention also relates to a hearing device with at least one input transducer, for generating an input signal; a signal processing unit connected to the input transducer, for generating a preliminary output signal from the input signal; and at least one output transducer for reproducing an output signal; the signal processing unit being arranged so as to generate the output signal from the input signal and the preliminary output signal by a method according to the invention. The advantages mentioned for the method and for the refinements thereof may be transferred analogously to the hearing device.

Other features which are considered as characteristic for the invention are set forth in the appended claims.

Although the invention is illustrated and described herein as embodied in a method of operating a hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Components and magnitudes that correspond to each other are provided with the same reference signs in all drawings.

Figure 1:
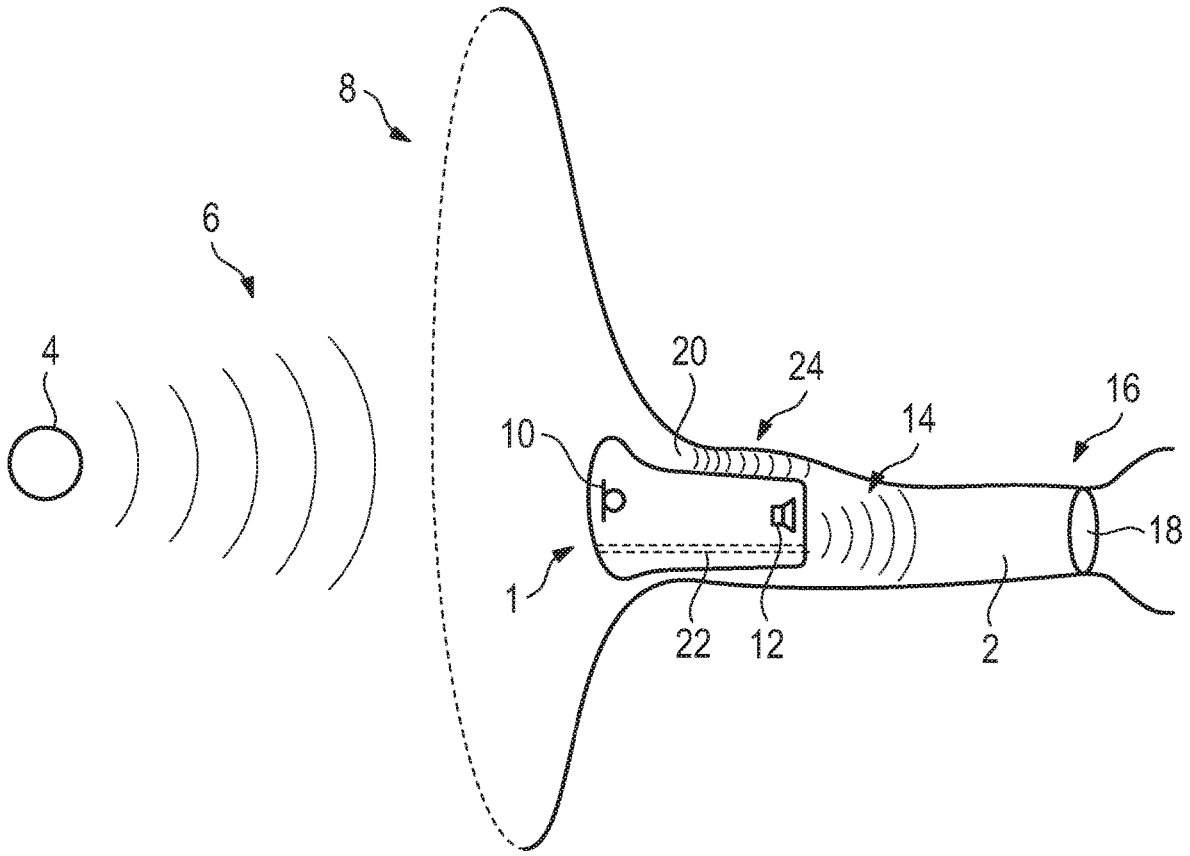
FIG. 1 is a diagrammatic, longitudinal view of a hearing device in an ear canal through which direct sound also propagates to the user's hearing system.

Referring now to the figures of the drawings in detail and first, particularly to FIG. 1 thereof, there is shown a longitudinal section of a hearing device 1, which is arranged in an ear canal 2 of a user, who is not otherwise shown in detail. In this example, the hearing device 1 is configured as an in-the-ear (ITE) instrument. Distant from the hearing device 1, there is an external sound source 4 from which a sound signal 6 is emitted to an ear 8 of the user of the hearing device 1. An input transducer 10 of the hearing device converts the sound signal 6 into an input signal, in a manner not yet described, and the hearing device 1 further processes and in particular amplifies the input signal in a frequency-dependent manner, and as a result of the processing by an output transducer 12 of the hearing device 1, an output sound signal 14 dependent on the sound signal 6 is generated in the ear canal 2. The output sound signal 14 propagates through the ear canal 2 to the user's hearing system 16, which particularly includes an eardrum 18. Through a narrow gap 20 between the hearing device 1 and the ear canal 2, or alternatively through a vent 22 furnished in the hearing device 1, which may be provided there to prevent occlusion effects, a part of the sound signal 6 likewise propagates to the user's hearing system 16 as direct sound 24. In this case, the output sound signal 14 and direct sound 24 are superposed in the ear canal 2. Because the output sound signal 14 has a certain delay compared to the direct sound signal 24 due to the filters used for signal processing in the hearing device 1, comb filter effects occur in this superposition as a function of the ratio of the amplitudes of the output sound signal 14 to the direct sound signal 24 and as a function of frequency. These effects are shown in FIG. 2.

Figure 2:
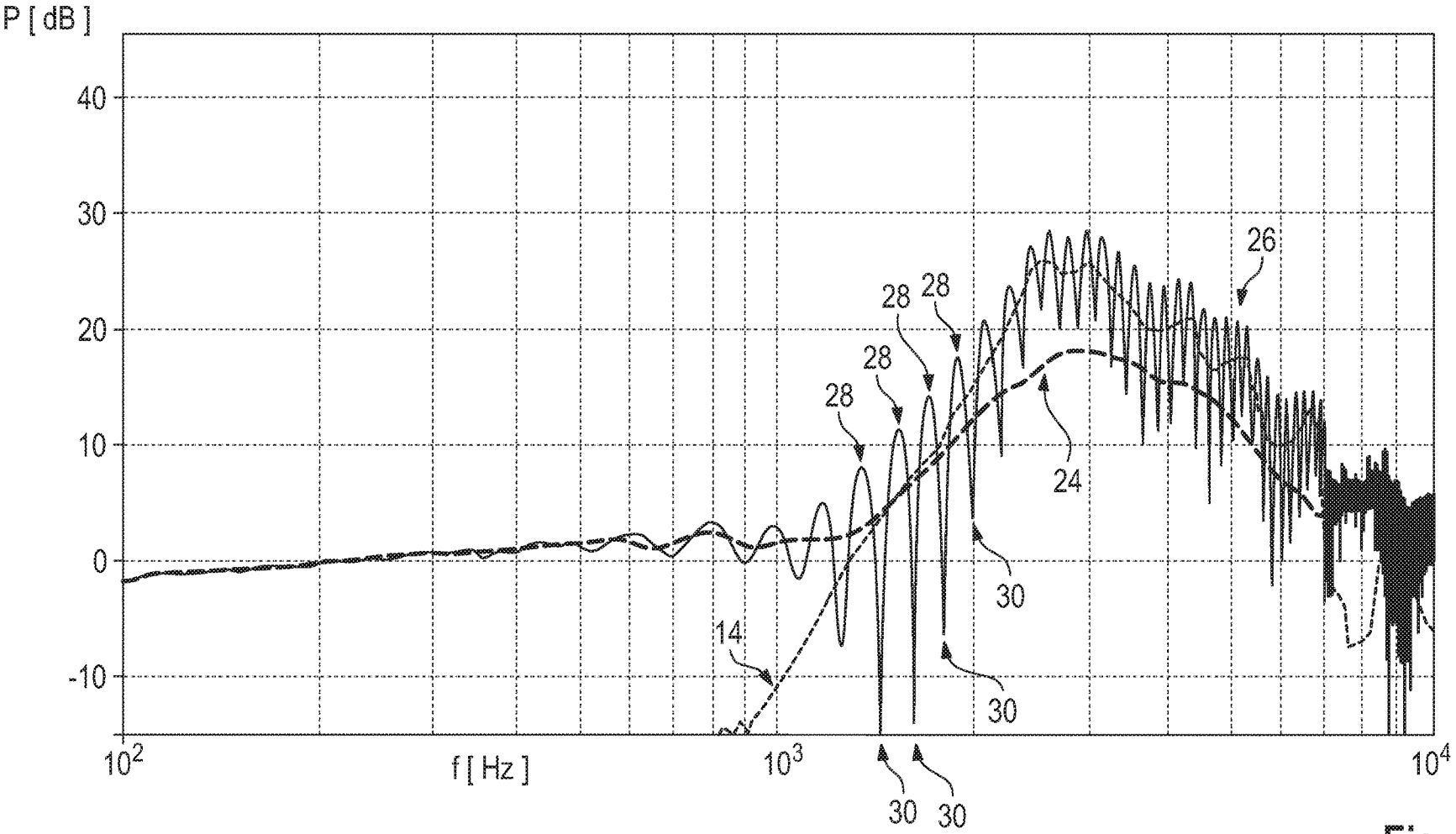
FIG. 2 is a graph showing a frequency response for direct sound, an output sound signal from the hearing device and a sound signal resulting from the superposition.

FIG. 2 schematically depicts a diagram of a frequency response for direct sound 24 (dashed line), for the output sound signal 14 (dotted line) amplified by the hearing device according to FIG. 1, and for the sound signal 26 (solid line) that results from the superposition, with the sound level P being plotted against a frequency f in each case. As a result of the aforementioned propagation delay in signal processing in the hearing device, the direct sound 24 and the output sound signal 14 overlap with a time delay.

In the resulting sound signal 26, it is apparent that at certain frequencies, the time-delayed superposition leads to constructive interferences 28, which leads to an elevated sound level overall in the superimposed sound signal 26. In contrast, at some frequencies the delayed superposition leads to destructive interference 30, which sometimes even results in a near-complete cancellation of the superimposed sound signal 26. The maxima representing the constructive interferences 28 are at integer multiples of the frequency that corresponds to the reciprocal time delay in the hearing device, while the minima representing the destructive interferences 30 are found at half-integer multiples of this frequency. Depending on the frequency spectrum of the sound signal 6 according to FIG. 1 and the direct sound 24, the user-specific amplification for generating the output sound signal 14 as well as the time delay that occurs, the hearing device user may perceive the comb filter effects as very unpleasant.

Figure 3:
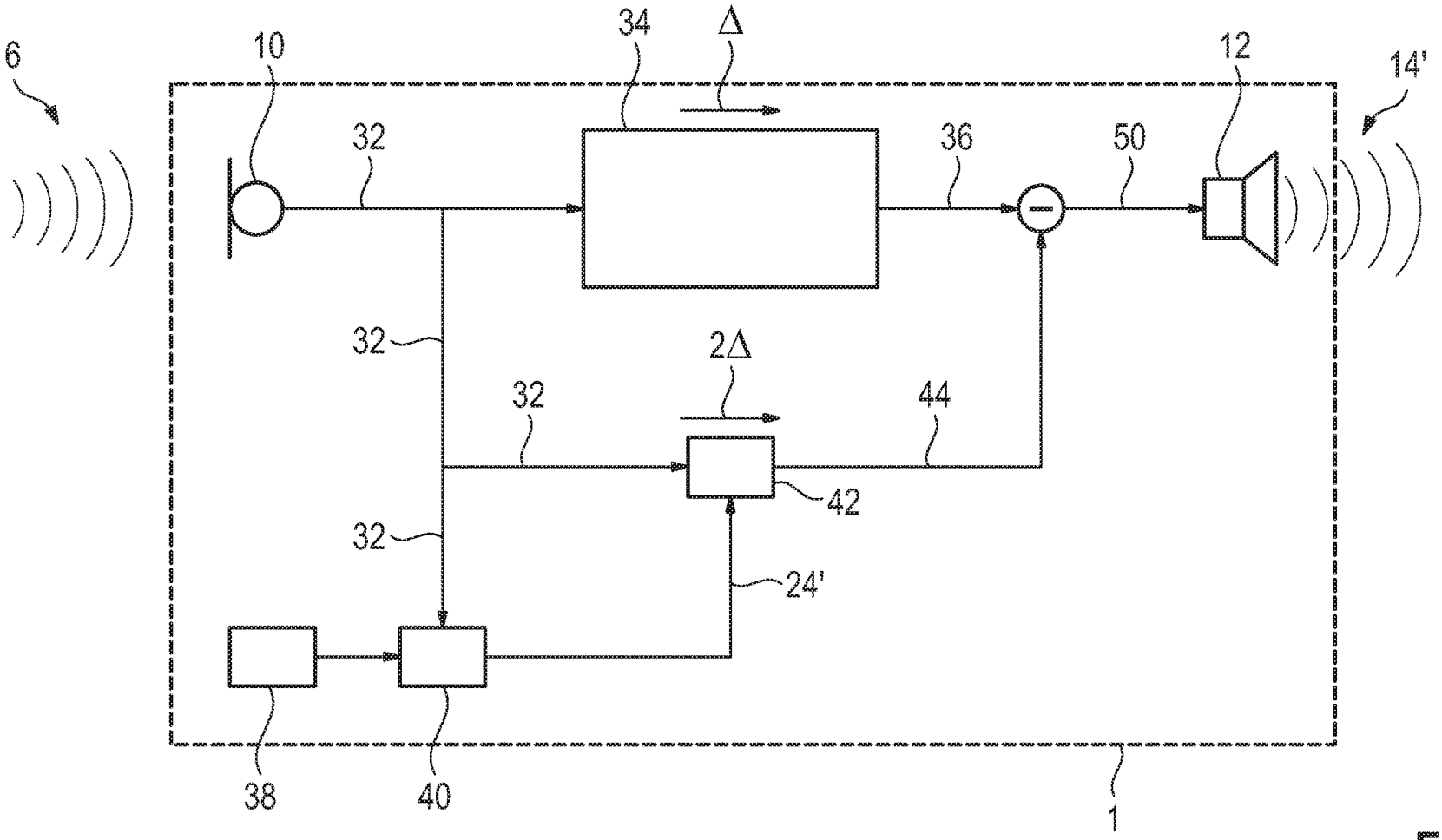
FIG. 3 is a block diagram of a method for suppressing comb filter effects in a hearing device according to FIG. 1.

FIG. 3 shows a schematic block diagram of a method for suppressing the comb filter effects according to FIG. 2 in hearing device 1 according to FIG. 1. The input transducer 10, which in this case takes the form of a microphone, first generates an input signal 32 from the sound signal 6. Based on this input signal 32, the signal processing 34 generates a preliminary output signal 36, and this signal processing in particular contains the user-specific algorithms for compensating for the user's hearing deficit by frequency-band-specific amplification in accordance with the audiogram. Likewise, an expected direct sound 24' that is expected to be heard at the user's hearing 16, which ideally corresponds exactly to the real direct sound 24, which propagates to the user's hearing system 16, is now ascertained based on the input signal 32, by previously determined and stored parameters 38, which provide information about a direct sound path through the ear canal 2, leading past the hearing device 1 and about the frequency response.

In this case, for example, an amplitude spectrum of the expected direct sound 24' is determined based on the sound signal 6 and the input signal 32, by a corresponding first transfer function 40 that takes the parameters 38 into account.

Based on the expected direct sound 24', a masking signal 44 is generated for those frequency ranges for which a sound signal that the output transducer 12 generates based on the preliminary output signal 36 would have a sound level between −6 dB lower and 12 dB higher. In this case, the masking signal 44 is such that its amplitude contributions, taking into account the reproduction characteristic of the output transducer 12, correspond substantially to the amplitude contributions of the expected direct sound 6', but are delayed by a time interval 2Δ with respect thereto—and substantially with respect to the input signal 32—where Δ indicates the propagation delay in the hearing device 1, and this delay arises substantially from the filters used in signal processing 34.

The specific generation of the masking signal 44 may also be done again via a second transfer function 42 and the input signal 32, with the dependency on the expected direct sound 24' then being determined indirectly via the input signal 32. However, a change in the expected direct sound 24' also results in a change in the masking signal 44 in this case, because a change in the expected direct sound 24' entails a change in the sound signal 6 and therefore in the input signal 32.

The masking signal 44 is then superimposed with the preliminary output signal 36, and the output signal 50 is generated from that superposition. The output transducer 12, which here takes the form of a loudspeaker, then converts the output signal 50 into the output sound signal 14'. The output sound signal 14' differs from the output sound signal 14 according to FIG. 2 in that the expected direct sound 24' is accounted for by means of the masking signal 44.

As shown in FIG. 1, the output sound signal 14' propagates via the ear canal 2, where it overlaps with the real direct sound 24, to reach the user's eardrum 18. The masking signal 44 avoids comb filter effects in the sound signal that result from the output sound signal 14' being superimposed on the direct sound signal 24. How this suppression takes place is illustrated in FIGS. 4A-5B.

Figure 4A:
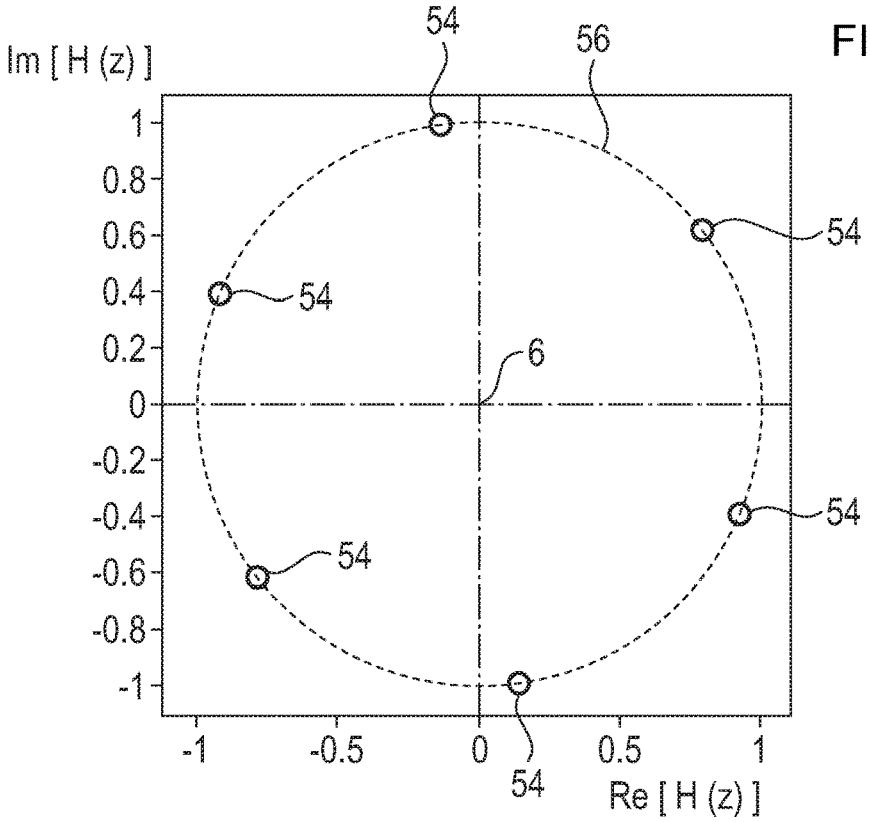
FIG. 4A is a pole-zero graph a transfer function of an output sound signal superimposed by direct sound without a masking signal.
Figure 4B:
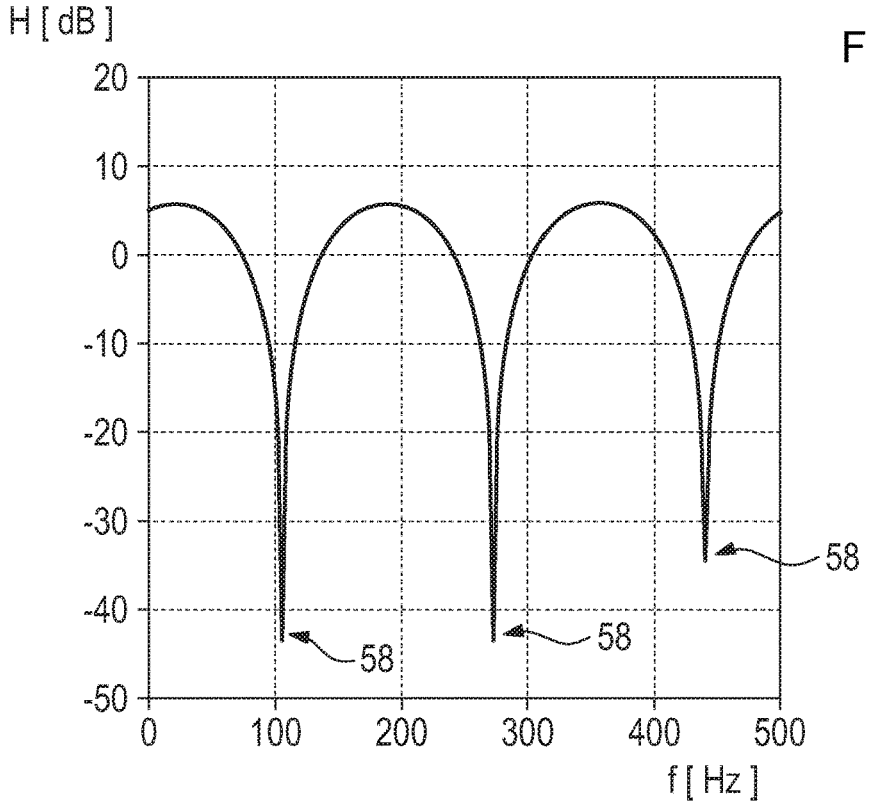
FIG. 4B is a graph of a frequency response of the transfer function of the resulting sound signal according to FIG. 4A.

FIG. 4A shows a pole-zero diagram for the transfer function H(z) of an output sound signal superimposed on the direct sound, without using a masking signal 44 according to FIG. 3. The zeroes 54 of the resulting signal traverse the unit circle line 56. In this case, the output sound signal and the direct sound have the same amplitudes for the examined frequency spectrum from 0 to 500 Hz. FIG. 4B shows the frequency response of the transfer function of the resulting sound signal 26 or incoming sound signal 6 according to FIG. 1, in dB, plotted against frequency f. The attenuations 58, which respectively correspond to a zero point 54 in the positive and the negative imaginary half-plane, are clearly apparent. The destructive interferences 30 according to FIG. 2 cause cancellations 58 that correspond to a zero point 54 of the transfer function.

Figure 5A:
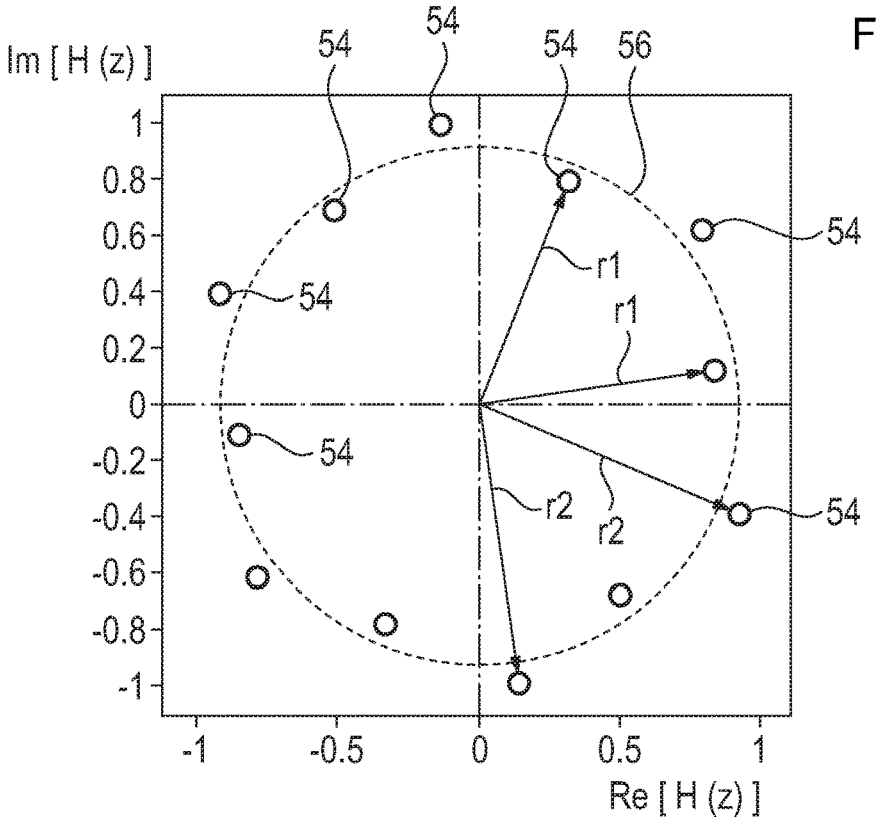
FIG. 5A is a pole-zero graph of the transfer function according to FIG. 4A with a masking signal.
Figure 5B:
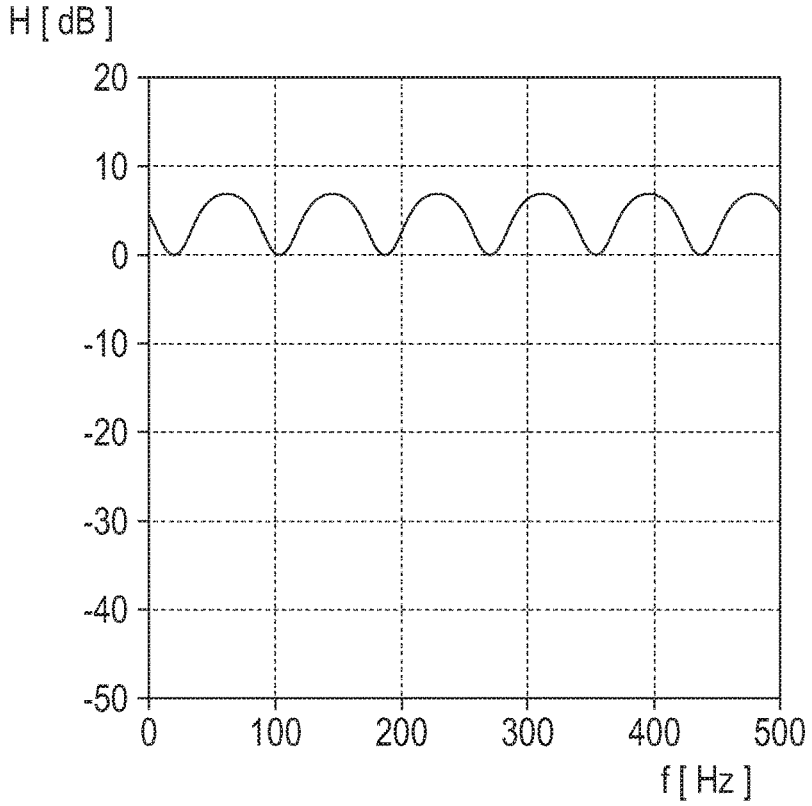
FIG. 5B is a graph of a frequency response of the transfer function of the resulting sound signal according to FIG. 5A.

FIG. 5A shows a pole-zero diagram for the situation according to FIG. 4A, in which the method according to FIG. 3 was also used to generate the output sound signal, i.e. in particular a masking signal 44 was added to the preliminary output signal 36. Clearly, the zeroes 54 no longer run along the unit circle line 56, but are slightly set apart from the same with an alternating smaller radius $r_1$ or larger radius $r_2$. The frequency response of the transfer function shown in FIG. 5B no longer shows any cancellations 58, and instead shows only a small ripple of approx. 6 dB. In this case, the amplitude of the masking signal corresponds to the amplitude of the direct sound, and the masking signal is delayed relative to the direct sound by twice the value of the delay between the direct sound and the preliminary output signal.

Figure 6:
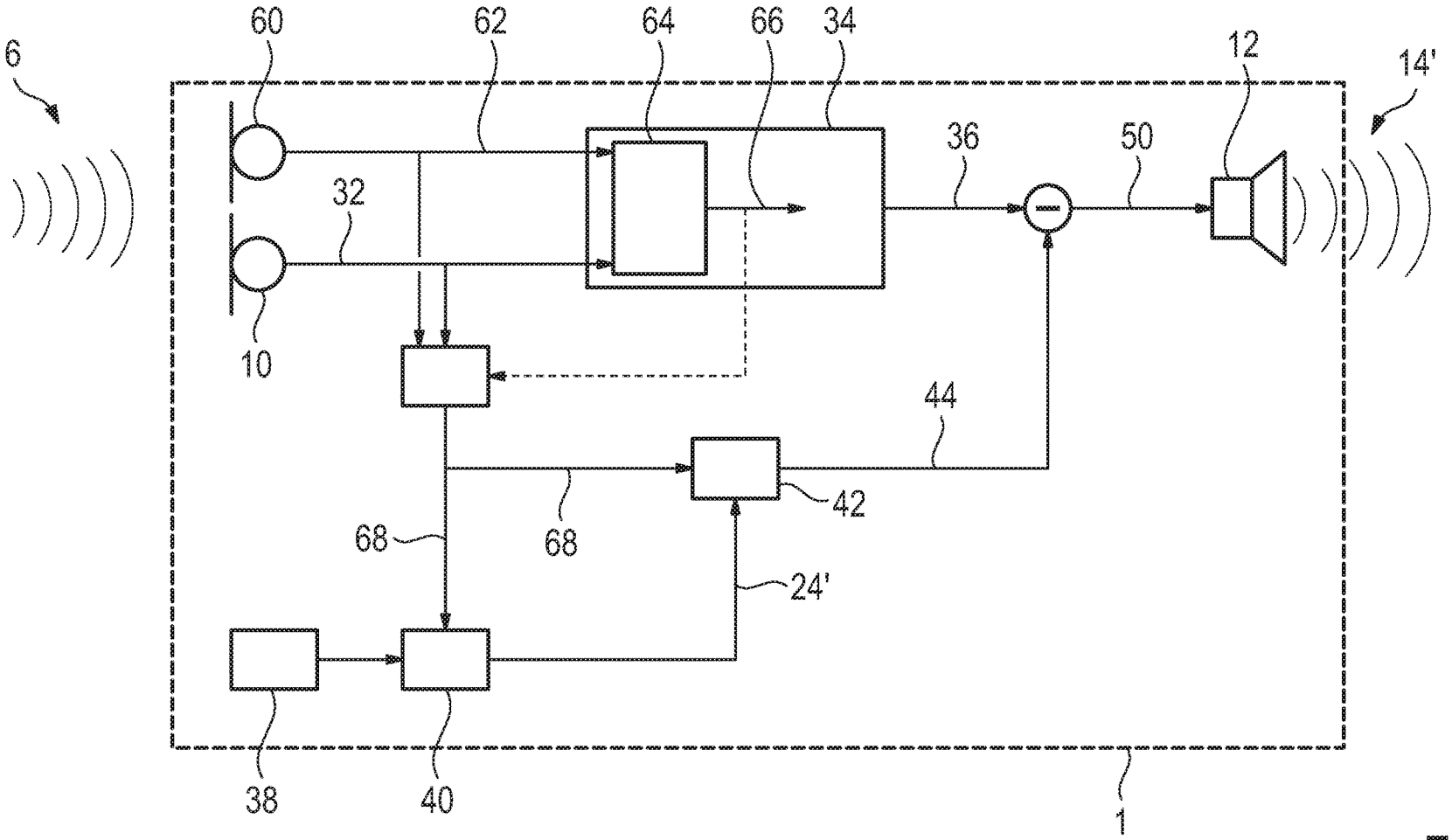
FIG. 6 is a block diagram of an alternative configuration of the method according to FIG. 3 using directional microphony.

FIG. 6 shows a block diagram for an alternative configuration of the method according to FIG. 3. Here, the hearing device 1 has an additional input transducer 60 that generates an additional input signal 62. In a first block 64 of the signal processing 34, a directional signal 66 is generated from the input signal 32 and the additional input signal 62. The masking signal 44 may be generated in this case by estimating the expected direct sound 24' based on the input signal 32 and additional input signal 62 and/or based on the directional signal 66. An additional directional signal 68 is generated from the existing input signals 32, 62, optionally taking into account the directional signal 66. This additional signal may be identical to the directional signal 66, or may have some differences, for example if the directional signal 66 is not exactly aligned with the source of the direct sound. The masking signal 44 is now generated based on the additional directional signal 68, comparably to the method described in FIG. 3.

Although the invention was illustrated and described in greater detail by means of the preferred exemplary embodiment, this exemplary embodiment does not limit the invention. A person of ordinary skill in the art will be able to derive other variations herefrom, without departing from the invention's protected scope.

The following is a summary list of reference numerals and the corresponding structure used in the above description of the invention:

1 Hearing device
2 Ear canal
4 External sound source
6 Sound signal
8 Ear
10 Input transducer
12 Output transducer
14 Output sound signal
14' Output sound signal
16 Hearing system
18 Eardrum
20 Gap
22 Vent
24 Direct sound
24' Expected direct sound
26 Resulting sound signal
28 Constructive interference
30 Destructive interference
32 Input signal
34 Signal processing
36 Preliminary output signal
38 Parameter
40 First transfer function
42 Second transfer function
44 Masking signal
50 Output signal
54 Null
56 Unit circle
58 Cancellation
60 Additional input transducer
62 Additional input signal
64 First block of signal processing
66 Directional signal
f Frequency
H(z) Transfer function
$r_1$ Radius
$r_2$ Radius
Δ Propagation delay

The invention claimed is:

1. A method of operating a hearing device, which further comprises:

generating an input signal from at least one input transducer of the hearing device;

generating a preliminary output signal from the input signal through signal processing;

ascertaining an expected direct sound that is expected to be perceived at a hearing system of a user of the hearing device based on the input signal;

determining an amplitude spectrum of the expected direct sound based on the input signal;

ascertaining a propagation delay of the preliminary output signal with respect to the expected direct sound;

ascertaining an amplitude spectrum of the preliminary output signal;

generating a masking signal based on the input signal and/or the preliminary output signal, taking into account the expected direct sound and/or the propagation delay of the preliminary output signal with respect to the expected direct sound, the generating step further including predetermining an amplitude spectrum of the masking signal in dependence on the amplitude spectrum of the expected direct sound and on the amplitude spectrum of the preliminary output signal, wherein the amplitude spectrum of the masking signal is predetermined in such a way that the masking signal has non-zero amplitude contributions substantially only for frequencies for which an output sound signal that an output transducer of the hearing device generates based on the preliminary output signal has a sound level that is between −6 dB below and 12 dB above the expected direct sound; and generating an output signal based on the preliminary output signal and the masking signal.

2. The method according to claim 1, wherein non-zero values of the amplitude spectrum of the masking signal are substantially provided by the amplitude spectrum of the expected direct sound.

3. The method according to claim 1, which further comprises generating the masking signal in such a way that a selected delay of an amplitude contribution of the masking signal, with respect to a corresponding amplitude contribution of the expected direct sound, is between 190% and 210% of the propagation delay of the preliminary output signal with respect to the expected direct sound.

4. The method according to claim 1, which further comprises forming a number of amplitude contributions of the masking signal based on phase-inverted amplitude contributions of the expected direct sound.

5. The method according to claim 1, which further comprises:

generating, via an additional input transducer of the hearing device, an additional input signal;

generating the preliminary output signal as a directional signal based on the additional input signal by means of signal processing; and generating the masking signal based on the input signal and/or additional input signal and/or the directional signal.

6. A hearing device, comprising:

at least one input transducer for generating an input signal;

a signal processing unit connected to said input transducer and generating a preliminary output signal from the input signal;

at least one output transducer for reproducing an output signal;

said signal processing unit is disposed so as to generate the output signal from the input signal and the preliminary output signal; and said hearing device programmed to:

ascertain an expected direct sound that is expected to be perceived at a hearing system of a user of the hearing device based on the input signal;

determine an amplitude spectrum of the expected direct sound based on the input signal;

ascertain a propagation delay of the preliminary output signal with respect to the expected direct sound;

ascertain an amplitude spectrum of the preliminary output signal;

generate a masking signal based on the input signal and/or the preliminary output signal, taking into account the expected direct sound and/or the propagation delay of the preliminary output signal with respect to the expected direct sound, the generate step further includes predetermining an amplitude spectrum of the masking signal in dependence on the amplitude spectrum of the expected direct sound and on the amplitude spectrum of the preliminary output signal, wherein the amplitude spectrum of the masking signal is predetermined in such a way that the masking signal has non-zero amplitude contributions substantially only for frequencies for which an output sound signal that an output transducer of the hearing device generates based on the preliminary output signal has a sound level that is between −6 dB below and 12 dB above the expected direct sound; and generate the output signal based on the preliminary output signal and masking signal.

* * * * *